US008894554B2

(12) United States Patent
Chen

(10) Patent No.: US 8,894,554 B2
(45) Date of Patent: Nov. 25, 2014

(54) PIVOTAL PULLEY FOR EXERCISE MACHINE

(76) Inventor: Paul Chen, Richmond (CA)

( * ) Notice: Subject to any disclaimer, the term of this patent is extended or adjusted under 35 U.S.C. 154(b) by 319 days.

(21) Appl. No.: 13/548,271

(22) Filed: Jul. 13, 2012

(65) Prior Publication Data

US 2014/0018218 A1 Jan. 16, 2014

(51) Int. Cl.
*A63B 21/00* (2006.01)

(52) U.S. Cl.
USPC ..... 482/121; 482/142; 482/130

(58) Field of Classification Search
USPC ..... 482/121, 124, 904, 142, 130
See application file for complete search history.

(56) References Cited

U.S. PATENT DOCUMENTS

| | | | | |
|---|---|---|---|---|
| 4,949,958 | A | 8/1990 | Richey | |
| 5,092,586 | A | 3/1992 | Tuthill et al. | |
| 5,221,245 | A | 6/1993 | Yeh | |
| 5,330,405 | A | 7/1994 | Habing et al. | |
| 5,645,514 | A | 7/1997 | Chen | |
| 5,899,836 | A | 5/1999 | Chen | |
| 6,220,994 | B1 * | 4/2001 | Rich | 482/123 |
| 6,245,001 | B1 * | 6/2001 | Siaperas | 482/142 |
| 6,258,011 | B1 * | 7/2001 | Wolfe | 482/23 |
| 7,549,949 | B2 | 6/2009 | Webber et al. | |
| 7,635,325 | B2 | 12/2009 | Chiang et al. | |
| 7,766,802 | B2 | 8/2010 | Webber et al. | |
| 2006/0128540 | A1 * | 6/2006 | Engle | 482/123 |
| 2008/0318742 | A1 * | 12/2008 | Califano | 482/124 |
| 2010/0167886 | A1 * | 7/2010 | Ko | 482/123 |
| 2013/0260971 | A1 * | 10/2013 | Cole et al. | 482/142 |

* cited by examiner

*Primary Examiner* — Jerome W Donnelly
(74) *Attorney, Agent, or Firm* — Charles E. Baxley

(57) ABSTRACT

A physical exercising machine includes a platform to support a user, an aperture formed in the platform, a pulley device includes a shaft for engaging with the aperture of the base and for pivotally attaching to the base, a shank is extended from the shaft and pivotal relative to the base with the shaft, a bracket is rotatably attached to the shank, and a pulley member is rotatably attached to the bracket with a spindle, and a cable is engaged with the pulley member, the pulley member is pivotal relative to the base with the shaft and rotatable relative to the shank for preventing the pulling cable from being disengaged from the pulley member and for allowing the user to suitably actuate or operate the pulling cable.

16 Claims, 7 Drawing Sheets

PIVOTAL PULLEY FOR EXERCISE MACHINE

BACKGROUND OF THE INVENTION

1. Field of the Invention

The present invention relates to a physical exercising machine, and more particularly to a pull type physical exercising machine including a pivotal pulley device for suitably and stably supporting or engaging with a pulling wire or cable or the like and for preventing the pulling wire or cable from being disengaged from the pivotal pulley device and for allowing the user to suitably and effectively actuate or operate the pulling wire or cable in order to suitably and stably exercise or train the upper muscle groups of the user.

2. Description of the Prior Art

Typical physical exercising machines comprise a supporting stand disposed or supported on the supporting ground or surface for supporting the user thereon, one or more pulleys attached or mounted or secured on the supporting stand for engaging with a pulling wire or cable or the like, and a handle or hand grip coupled to the pulling wire or cable for pulling and stretching the pulling wire or cable in order to exercise or train the upper muscle groups of the users.

For example, U.S. Pat. No. 4,949,958 to Richey, U.S. Pat. No. 5,221,245 to Yeh, U.S. Pat. No. 5,330,405 to Habing et al., U.S. Pat. No. 5,645,514 to Chen, U.S. Pat. No. 5,899,836 to Chen, U.S. Pat. No. 7,549,949 to Webber et al., and U.S. Pat. No. 7,766,802 to Webber et al. disclose several of the typical multifunction exercise apparatuses each comprising a frame supporting various exercising stations or members or facilities, and a cable and pulley system coupling to various operable or weight members and having a handle or hand grip coupled to the pulling wires or cables for being actuated or operated by the user to pull the pulling wires or cables in order to suitably and stably exercise or train the upper muscle groups of the user.

However, the pulling wires or cables are required to be engaged with one or more pulleys, and the pulleys are normally solidly and stably attached or mounted or secured on the supporting stand or the exercising stations or members or facilities and the like, and the pulleys may not be pivoted or rotated relative to the supporting stand or the exercising stations or members or facilities and the like such that the pulling wires or cables may have a good chance to be disengaged or removed from the pulleys inadvertently while in use.

Typical tilting or balancing exercisers comprise a disk or plate or foot support for supporting a user thereon, and a curved or rounded member attached to the bottom of the foot support and for attempting to maintain the disk or plate or foot support in a horizontal position or status, or for allowing the user to conduct the balancing exercises or operations.

For example, U.S. Pat. No. 5,092,586 to Tuthill et al. discloses one of the typical disk balancing exercisers comprising a disk or plate or foot support with threaded hole in its center for threading or engaging with the threaded bolt or screw which includes a hemispherical shoe attached to the bottom portion thereof for pivotally engaging with a supporting surface or ground and for allowing the typical disk balancing exercisers to be inclined or tilted relative to the supporting surface or ground and to be operated to maintain the foot support in a horizontal position or status, and for conducting the balancing exercises or operations.

However, the threaded bolt or screw and the foot support may be inclined or tilted a lot relative to the supporting surface or ground, and the users, particularly the elders and the children may feel afraid and may not use or operate the typical disk balancing exercisers.

U.S. Pat. No. 7,635,325 to Chiang et al. discloses a further typical interactive training device comprising an operation unit including an immovable base, a movable plate, and a supporting member disposed between the immovable base and the movable plate for allowing the movable plate to be inclined or tilted relative to the immovable base in order to conduct the balancing exercises or operations.

However, the tilting operation or the inclination of the movable plate is limited by the supporting member that may not be easily twisted or inclined or tilted relative to the supporting surface or ground, and the movable plate may not freely pivoted or rotated relative to the immovable base to conduct the balancing exercises or operations. Similarly, the elders and the children or the beginners may feel afraid and may not use or operate the typical disk balancing exercisers.

The present invention has arisen to mitigate and/or obviate the afore-described disadvantages of the conventional physical exercising machines.

SUMMARY OF THE INVENTION

The primary objective of the present invention is to provide a physical exercising machine including a pivotal pulley device for suitably and stably supporting or engaging with a pulling wire or cable or the like and for preventing the pulling wire or cable from being disengaged from the pivotal pulley device and for allowing the user to suitably and effectively actuate or operate the pulling wire or cable in order to suitably and stably exercise or train the upper muscle groups of the user.

In accordance with one aspect of the invention, there is provided a physical exercising machine comprising a base member including a platform having an aperture formed therein, a pulley device including a shaft for engaging with the aperture of the base and for pivotally attaching to the base, a shank extended from the shaft and pivotal relative to the base with the shaft, a bracket rotatably attached to the shank, and a pulley member rotatably attached to the bracket with a spindle, and a cable engaged with the pulley member.

The shank includes an anchoring device provided therein for engaging with the bracket and for rotatably attaching the bracket to the shank. The anchoring device is selected from a peripheral recess formed in the shank.

The bracket includes an orifice formed therein for receiving and engaging with the shank, and the bracket includes a peripheral flange for forming and defining the orifice of the bracket, and the peripheral flange of the bracket is engaged with the peripheral recess of the shank for rotatably attaching or anchoring the bracket to the shank.

The bracket includes a base plate having an orifice formed therein for receiving and engaging with the shank, and two flaps extended from the base plate for forming a U-shaped structure, and the pulley member is disposed between the flaps.

The flaps of the bracket each include a hole formed therein for receiving and engaging with the spindle, and the pulley member include a bore formed therein for receiving and engaging with the spindle and for rotatably attaching to the bracket with the spindle. The platform includes at least one opening formed therein for a handle member.

The base includes a latching device for engaging with the shaft and for pivotally attaching the shaft of the pulley device to the base. The base includes a lock notch formed therein for engaging with the shaft and for pivotally attaching the shaft of the pulley device to the base.

The base includes a pairs of ribs extended from the platform and disposed below the aperture of the base, and located at different side of the aperture of the base, and the aperture of the base is located between the pair of ribs, and the lock notch is formed in the ribs.

The ribs each include a narrowed neck portion provided therein for engaging with the shaft and for pivotally attaching the shaft of the pulley device to the base. The ribs each include the latching device extended into the lock notch for forming the narrowed neck portion in the ribs.

The platform includes a protrusion extended downwardly therefrom for forming a balancing exerciser. A supporting device may further be provided and includes a supporting element for engaging with the protrusion of the platform and for supporting the protrusion of the platform.

The supporting device includes a supporting frame member extended upwardly from the supporting element, and the supporting frame member may include at least one post extended therefrom and engaged with the cable.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
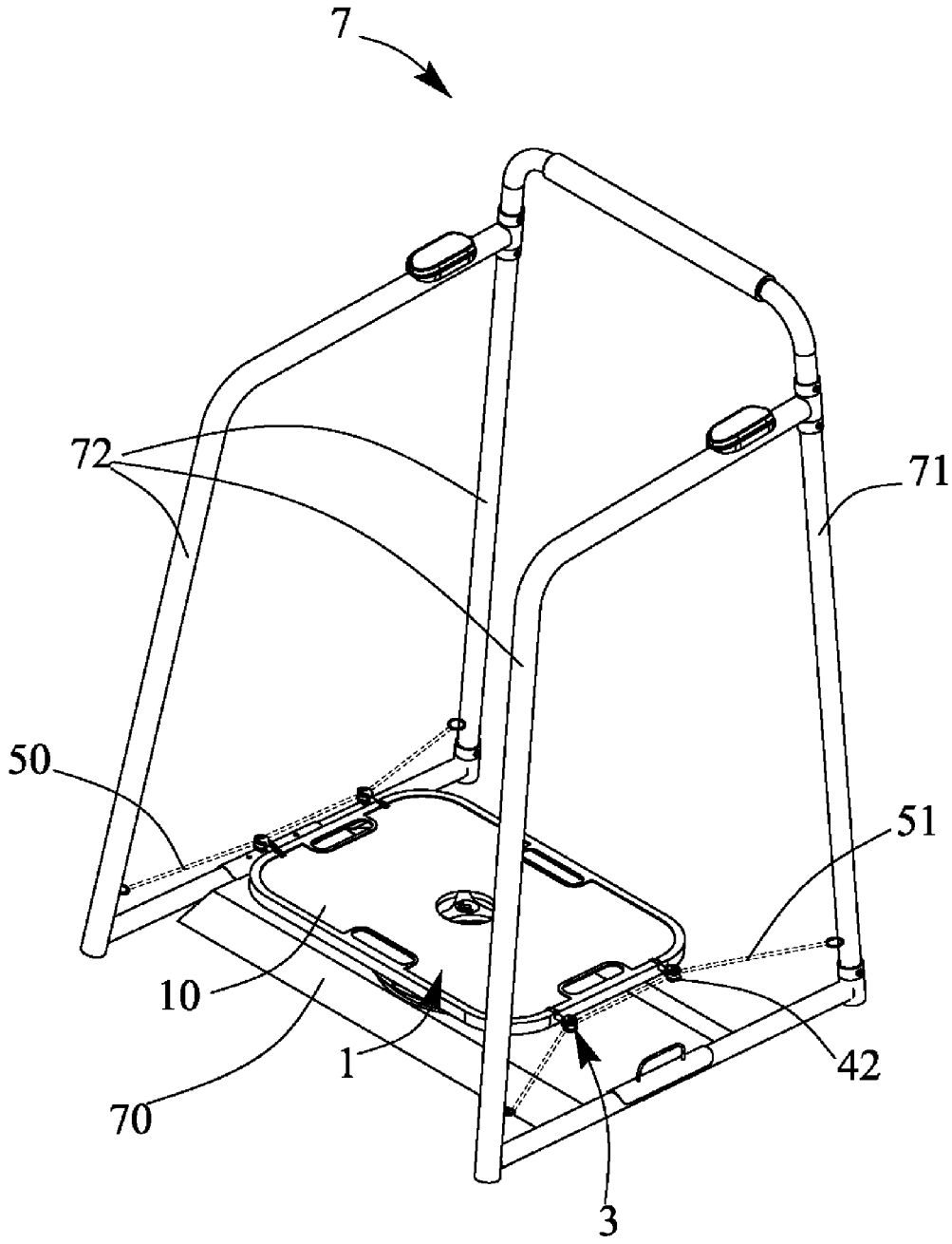
FIG. 1 is an upper perspective view of a physical exercising machine in accordance with the present invention.
Figure 2:
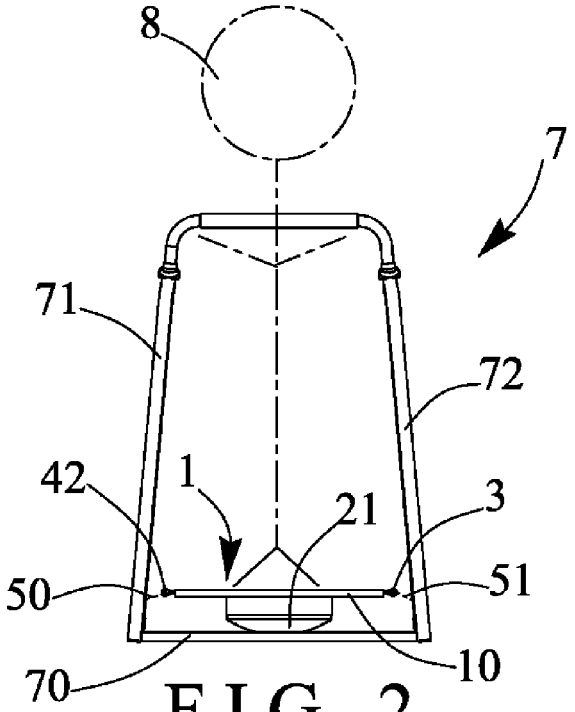
FIG. 2 is a front plan schematic view illustrating the operation of the physical exercising machine.
Figure 3:
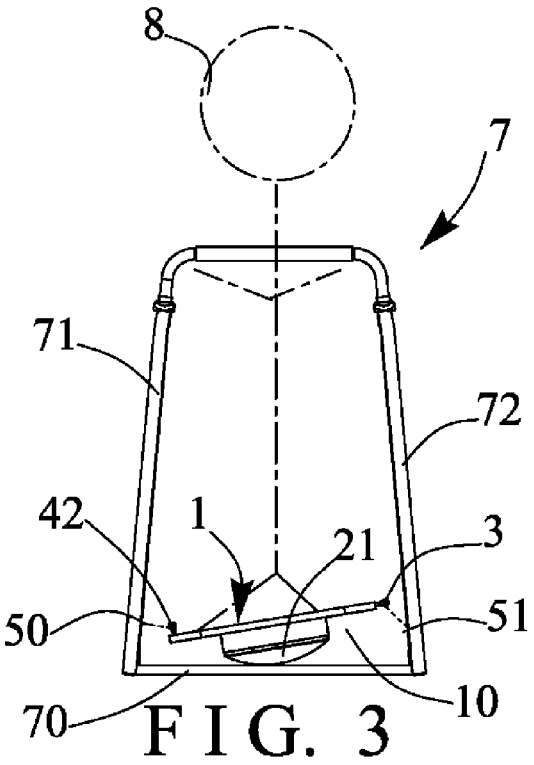
FIGS. 3, 4 are front plan schematic views similar to FIG. 2, illustrating the operation of the physical exercising machine.
Figure 4:
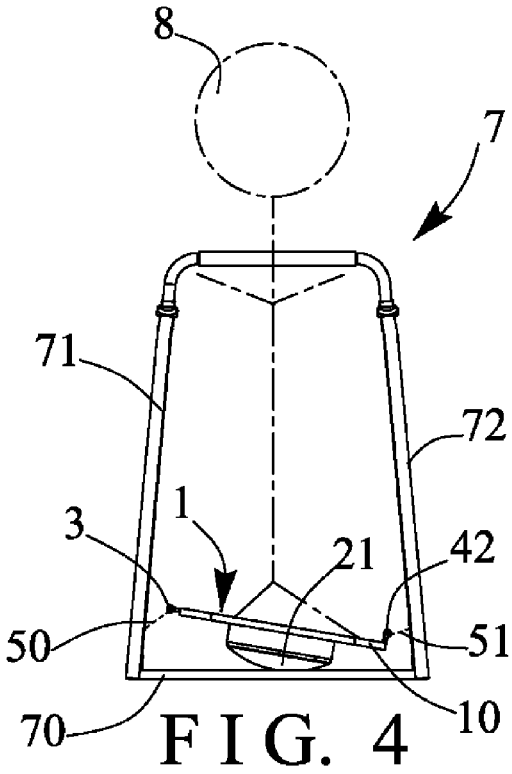
Figure 5:
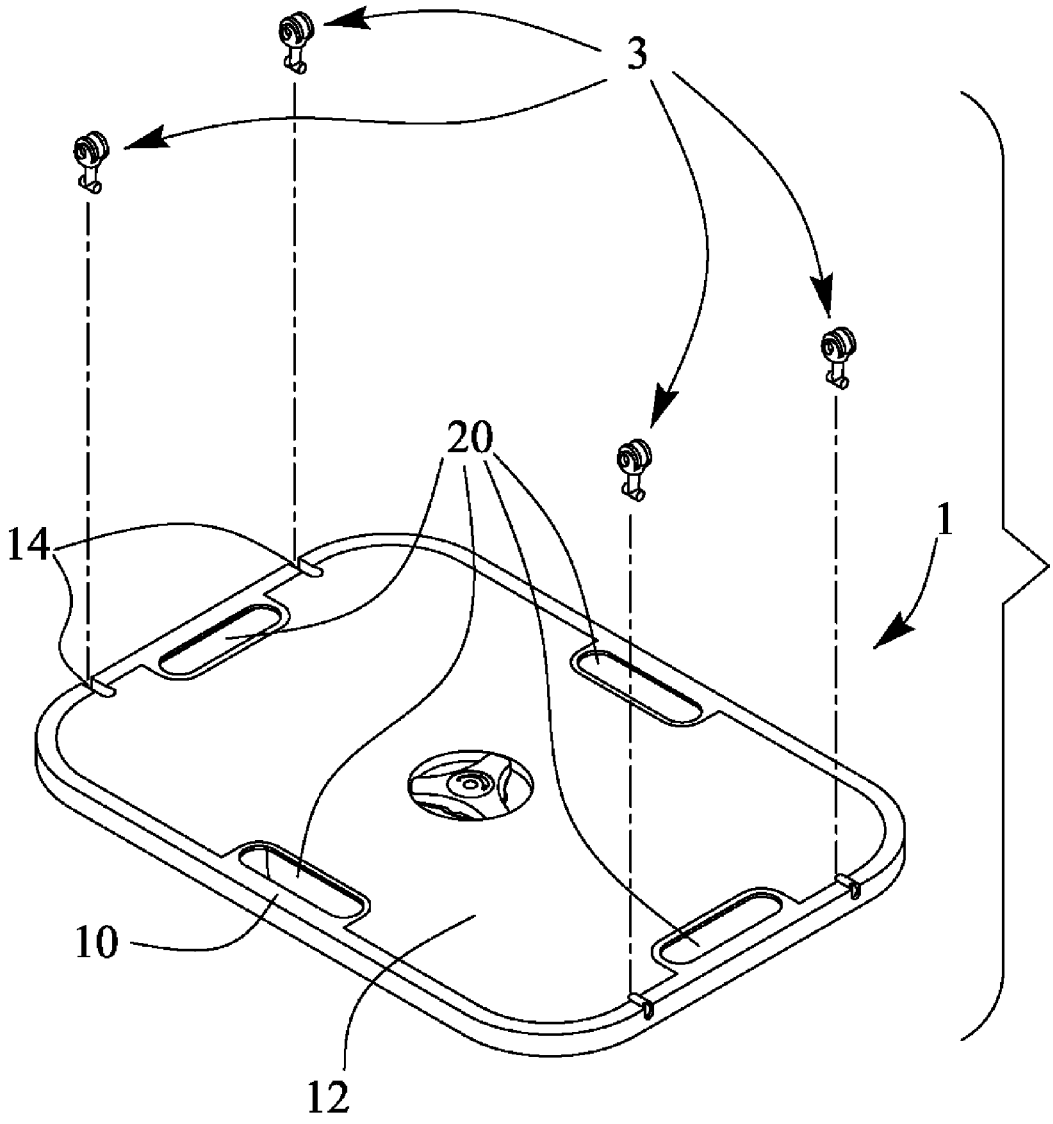
FIG. 5 is a partial exploded view of a tilting or balancing exerciser of the physical exercising machine.
Figure 6:
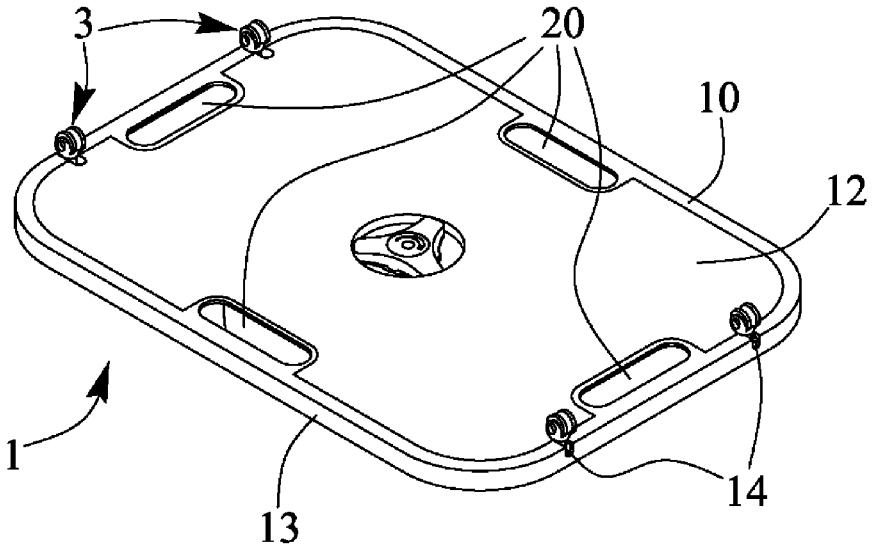
FIG. 6 is an upper perspective view of the balancing exerciser of the physical exercising machine.
Figure 7:
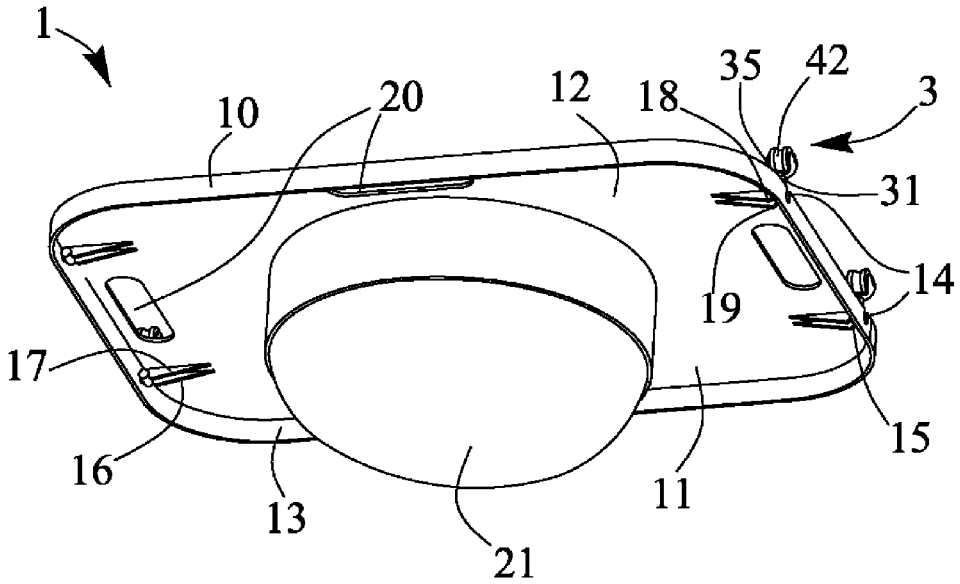
FIG. 7 is a bottom perspective view of the balancing exerciser of the physical exercising machine.
Figure 11:
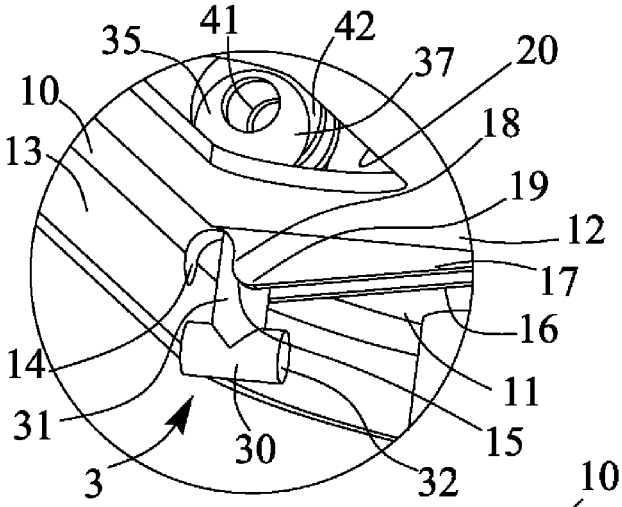
FIGS. 11, 12, 13 are enlarged partial bottom perspective views illustrating the operation of the pivotal pulley device of the physical exercising machine.
Figure 12:
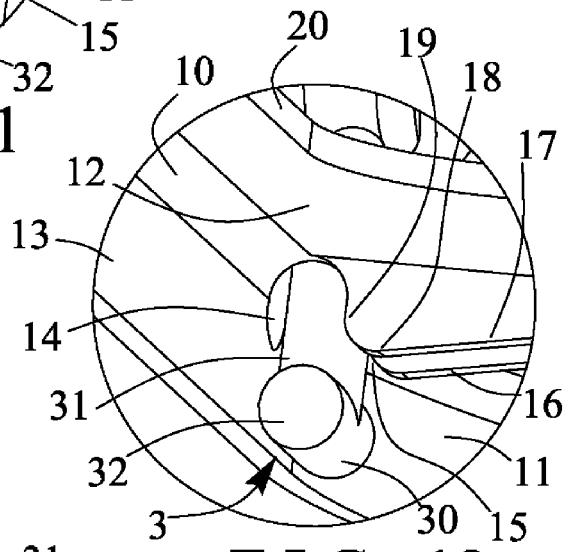
Figure 13:
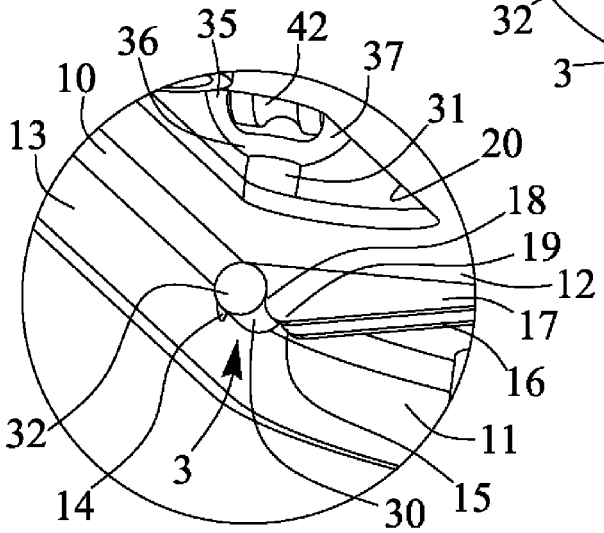
Figure 14:
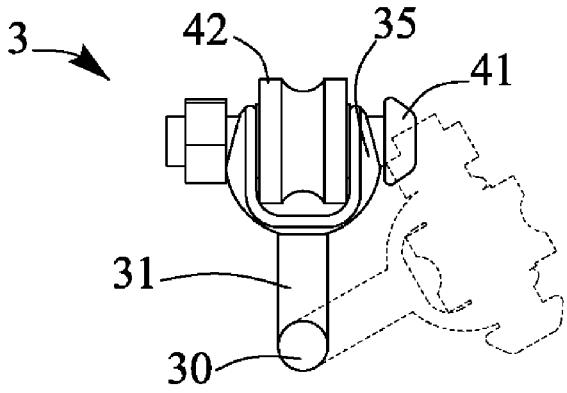
FIG. 14 is a side plan schematic view illustrating the operation of the pivotal pulley device of the physical exercising machine.

Referring to the drawings, and initially to FIGS. 1-4, a physical exercising machine in accordance with the present invention comprises a tilting or balancing exerciser 1 including a stationery frame or base member 10 (FIGS. 5-7) including a chamber 11 formed therein (FIGS. 7, 11-13), such as formed in the bottom portion thereof and formed or defined by an upper platform 12 and an outer peripheral wall or fence 13, and including one or more (such as four) apertures 14 formed in or formed through the platform 12 and communicative with the chamber 11 of the base member 10 for attaching or mounting or securing or engaging with pivotal pulley devices 3 respectively, and including one or more (such as four) lock notches 15 formed therein (FIGS. 7 and 11-13) and disposed or located below the respective apertures 14 and communicative with the apertures 14 of the base member 10 respectively (FIGS. 11-13) for anchoring or securing or retaining the pivotal pulley devices 3 to the base member 10.

For example, the base member 10 includes one or more (such as four) pairs of flanges or protrusions or projections or ribs 16, 17 extended downwardly from the platform 12 and extended or disposed or located within the chamber 11 of the base member 10, and disposed or located below the respective apertures 14 of the base member 10, and disposed or located at different side of the respective apertures 14 of the base member 10, or the respective aperture 14 of the base member 10 is located between the respective pair of ribs 16, 17, and the lock notch 15 is laterally formed through the ribs 16, 17, and the base member 10 and/or the ribs 16, 17 each include a narrowed neck portion 18 formed or provided therein; or one or both of the ribs 16, 17 each include a protrusion or projection or latching device 19 extended into the respective lock notch 15 for forming or defining the respective narrowed neck portion 18 in the respective ribs 16, 17. It is preferable, but not necessary that the platform 12 includes one or more (such as four) openings 20 formed in the outer peripheral portion thereof for forming or defining the handle members 20 which may be used for carrying and moving the platform 12.

The pivotal pulley devices 3 each include a shaft 30, and a stem or shank 31 extended upwardly from the shaft 30 for forming or defining an inverted T-shaped structure, and the shaft 30 includes a size or width or length or dimension for fitting or engaging into or through the respective apertures 14 of the base member 10 and into the chamber 11 of the base member 10 (FIGS. 11-13), the shaft 30 may then be pivoted or rotated relative to the base member 10 for about ninety (90) degrees (FIG. 12) and may have the end portions 32 of the shaft 30 fitted or engaged into the respective lock notches 15 of the ribs 16, 17 or of the base member 10, and/or engaged with the projections or latching devices 19 or the narrowed neck portions 18 of the ribs 16, 17 or of the base member 10 (FIG. 13) for allowing the pulley devices 3 to be easily and quickly and readily and detachably attached or mounted or secured to the base 10, and for allowing the shank 31 of the pulley devices 3 to be pivoted or rotated relative to the base member 10 with the shaft 30 (FIGS. 3-4, 10-12).

Figure 8:
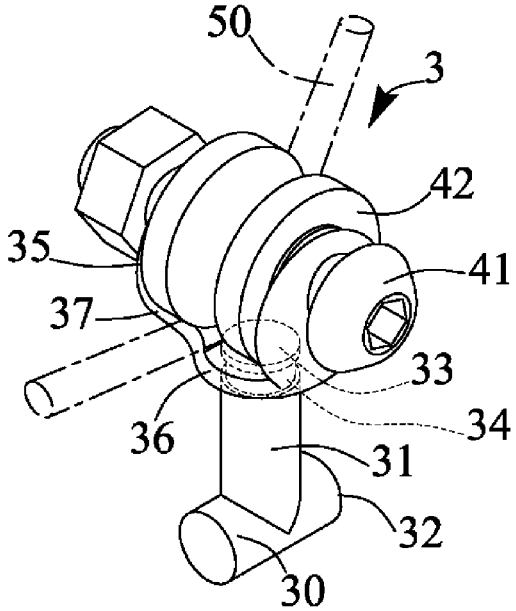
FIG. 8 is another perspective view illustrating one of the pivotal pulley devices for the physical exercising machine.
Figure 9:
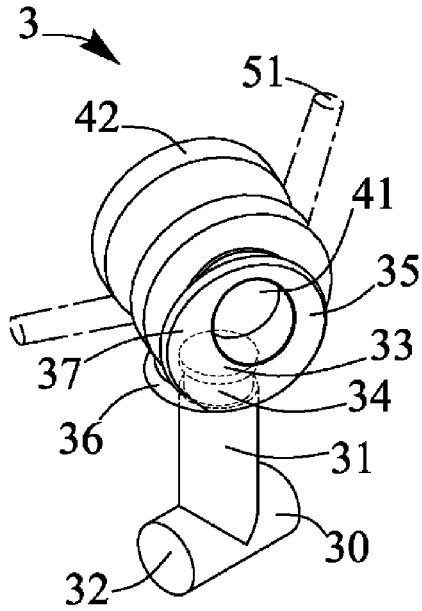
FIG. 9 is a further perspective view similar to FIG. 8, illustrating the operation of the pivotal pulley device of the physical exercising machine.
Figure 10:
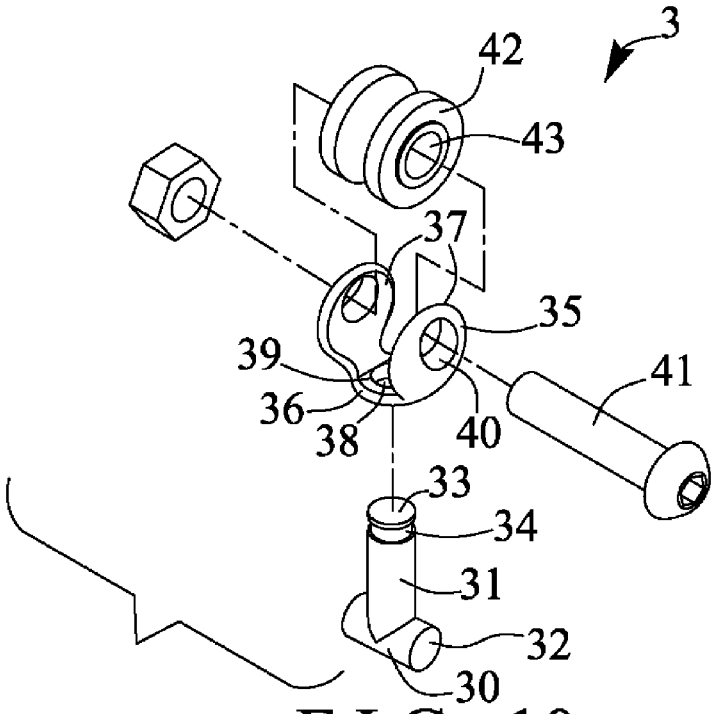
FIG. 10 is an exploded view of the pivotal pulley device of the physical exercising machine.

As shown in FIGS. 8-10, the shanks 31 of the pivotal pulley devices 3 each include an upper portion 33 having an attaching or mounting or securing or anchoring or retaining device or a peripheral depression or recess 34 formed therein. The pivotal pulley devices 3 each further include a frame or bracket 35 having a base plate 36 and two panels or flaps 37 extended upwardly from the base plate 36 for forming or defining a U-shaped structure, and the bracket 35 includes an orifice 38 formed therein and formed or defined by a peripheral flange 39 for receiving or engaging with the upper portion 33 of the shank 31, and the peripheral flange 39 of the bracket 35 is engaged with the peripheral recess 34 of the shank 31 for pivotally or rotatably attaching or mounting or securing or anchoring or retaining the bracket 35 to the shank 31.

The flaps 37 of the bracket 35 each include a hole 40 formed therein for receiving or engaging with a spindle 41, and the pivotal pulley devices 3 each include a wheel or roller or pulley member 42 disposed between the flaps 37 and having a bore 43 formed therein for receiving or engaging with the spindle 41 and for allowing the pulley member 42 to be pivotally or rotatably attached and mounted or anchored or secured or retained to the bracket 35. It is to be noted that the pivotal pulley device 3 is pivotal or rotatable relative to the base member 10 about or with the shaft 30, and the bracket 35 is pivotal or rotatable relative to the shank 31 and the shaft 30 such that the pulley member 42 is not solidly and stably attached or mounted or secured to the base member 10 and is pivotal or rotatable relative to the base member 10 about or with the shaft 30, and is also pivotal or rotatable relative to the shank 31 and the shaft 30.

Figure 15:
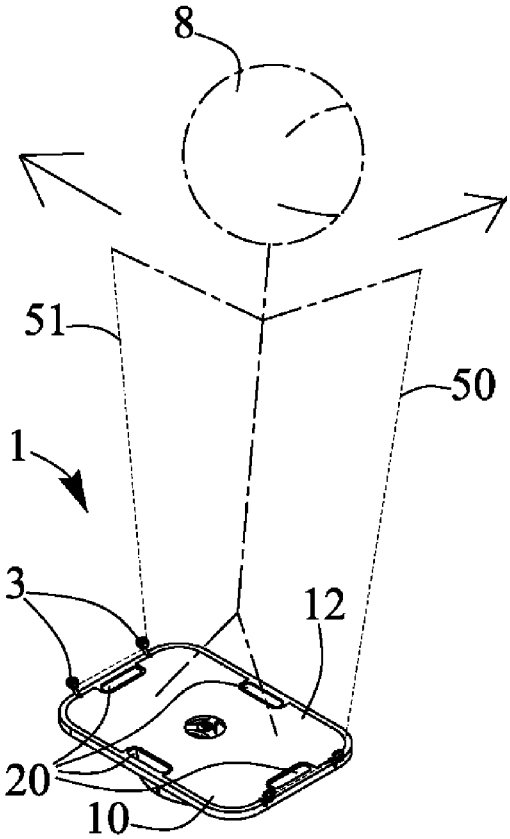
FIGS. 15, 16 are perspective views illustrating the operation of the physical exercising machine.
Figure 16:
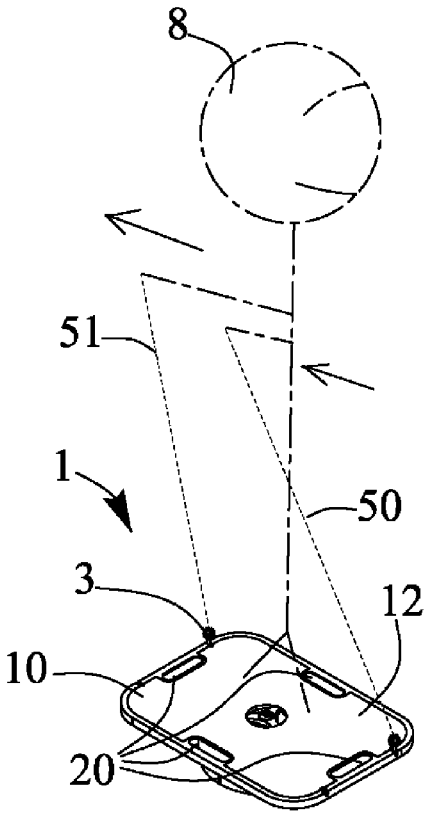

In operation, as shown in FIGS. 15 and 16, one or more pulling wires or cables 50, 51 may further be provided and attached or mounted or secured or coupled to the pulley members 42 of the pivotal pulley devices 3 for being pulled or actuated or operated by the user 8 and for allowing the user 8 exercise or train their upper muscle groups, even when the user 8 is conducting the balancing exercises or operations. The pulley members 42 are pivotal or rotatable relative to the base member 10 about or with the shafts 30, and are pivotal or rotatable relative to the shanks 31 and the shafts 30 for allowing the pulling wires or cables 50, 51 to be suitably engaged with the pulley members 42 and to be prevented from being disengaged or removed from the pulley members 42 inadvertently while in use.

Referring again to FIGS. 1-4 and 7, the balancing exerciser 1 includes a curved or rounded projection or protrusion 21 extended downwardly from the base member 10 for allowing the base member 10 to be tilted or inclined relative to the supporting ground or surface or element 70 of a supporting device 7 and to act as a balancing exerciser (FIGS. 2-4), and the supporting device 7 includes a supporting frame member 71 disposed or attached or mounted or secured or extended upwardly from the supporting element 70 for supporting the upper portion of the user, particularly the elders and the children who may feel afraid of operating the balancing exerciser 1, the pulling wires or cables 50, 51 may also be engaged with the pulley members 42 of the pivotal pulley device 3 and coupled to or between the posts 72 of the frame member 71 to apply a resilient or spring biasing and recovering force to selectively erect the base member 10.

Accordingly, the physical exercising machine in accordance with the present invention includes a pivotal pulley device for suitably and stably supporting or engaging with a pulling wire or cable or the like and for preventing the pulling wire or cable from being disengaged from the pivotal pulley device and for allowing the user to suitably and effectively actuate or operate the pulling wire or cable in order to suitably and stably exercise or train the upper muscle groups of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A physical exercising machine comprising:

a base member including a platform having an aperture formed therein, a pulley device including a shaft for engaging with said aperture of said base and for pivotally attaching to said base, a shank extended from said shaft and pivotal relative to said base with said shaft, a bracket rotatably attached to said shank, and a pulley member rotatably attached to said bracket with a spindle, and a cable engaged with said pulley member.

2. The physical exercising machine as claimed in claim 1, wherein said shank includes an anchoring device provided therein for engaging with said bracket and for rotatably attaching said bracket to said shank.

3. The physical exercising machine as claimed in claim 2, wherein said anchoring device is a peripheral recess formed in said shank.

4. The physical exercising machine as claimed in claim 3, wherein said bracket includes an orifice formed therein for receiving and engaging with said shank, and said bracket includes a peripheral flange for forming and defining said orifice of said bracket, and said peripheral flange of said bracket is engaged with said peripheral recess of said shank for rotatably attaching said bracket to said shank.

5. The physical exercising machine as claimed in claim 1, wherein said bracket includes a base plate having an orifice formed therein for receiving and engaging with said shank, and two flaps extended from said base plate for forming a U-shaped structure, and said pulley member is disposed between said flaps.

6. The physical exercising machine as claimed in claim 5, wherein said flaps of said bracket each include a hole formed therein for receiving and engaging with said spindle, and said pulley member include a bore formed therein for receiving and engaging with said spindle and for rotatably attaching to said bracket with said spindle.

7. The physical exercising machine as claimed in claim 1, wherein said base includes a latching device for engaging with said shaft and for pivotally attaching said shaft of said pulley device to said base.

8. The physical exercising machine as claimed in claim 1, wherein said base includes a lock notch formed therein for engaging with said shaft and for pivotally attaching said shaft of said pulley device to said base.

9. The physical exercising machine as claimed in claim 8, wherein said base includes a pairs of ribs extended from said platform and disposed below said aperture of said base, and located at different side of said aperture of said base, and said aperture of said base is located between said pair of ribs, and said lock notch is formed in said ribs.

10. The physical exercising machine as claimed in claim 9, wherein said ribs each include a narrowed neck portion provided therein for engaging with said shaft and for pivotally attaching said shaft of said pulley device to said base.

11. The physical exercising machine as claimed in claim 10, wherein said ribs each include a latching device extended into said lock notch for forming said narrowed neck portion in said ribs.

12. The physical exercising machine as claimed in claim 1, wherein said platform includes at least one opening formed therein for a handle member.

13. The physical exercising machine as claimed in claim 1, wherein said platform includes a protrusion extended downwardly therefrom for forming a balancing exerciser.

14. The physical exercising machine as claimed in claim 13 further comprising a supporting device including a supporting element for engaging with and for supporting said protrusion of said platform.

15. The physical exercising machine as claimed in claim 14, wherein said supporting device includes a supporting frame member extended upwardly from said supporting element.

16. The physical exercising machine as claimed in claim 15, wherein said supporting frame member includes at least one post engaged with said cable.

* * * * *